United States Patent [19]

Marshall et al.

[11] Patent Number: 4,646,953

[45] Date of Patent: Mar. 3, 1987

[54] FINGERNAIL POLISHING DEVICE

[75] Inventors: Judy R. Marshall, New York; Richard L. Miller, Dix Hills, both of N.Y.

[73] Assignee: Judy R. Marshall, New York, N.Y.

[21] Appl. No.: 800,221

[22] Filed: Nov. 21, 1985

[51] Int. Cl.[4] ..... A41D 19/00

[52] U.S. Cl. ..... 224/217; 132/73

[58] Field of Search ..... 224/148, 217, 901, 151; 128/87 A; 132/73, 73.5; 206/1.7; 215/100 R; 220/94 A

[56] References Cited

U.S. PATENT DOCUMENTS

| | | | |
|---|---|---|---|
| 2,140,231 | 12/1938 | Jefferis | 132/73 |
| 2,356,722 | 8/1944 | Harris | 224/217 X |
| 2,656,842 | 10/1953 | Ammarell | 132/73 |
| 2,865,384 | 12/1958 | Noon | 132/73 |

*Primary Examiner*—Stephen Marcus
*Assistant Examiner*—David Voorhees
*Attorney, Agent, or Firm*—Richard L. Miller

[57] ABSTRACT

This invention is a resilient, V-shaped clamp for support between a person's fingers; the clamp including a toothed pad to grip around a nail polish bottle, and including finger supporting tabs.

3 Claims, 4 Drawing Figures

FINGERNAIL POLISHING DEVICE

BACKGROUND OF THE INVENTION

This invention relates generally to fingernail grooming equipment. More specifically it relates to a nail polishing station, and is an improvement over the art such as is presented in the U.S. Pat. Nos.: 2,140,231 of Jefferis; 2,656,842 of Ammarell; and 2,662,534 of Swartz.

It is well known that many employed women these days cannot maintain neatly polished fingernails while working with their hands and so are obliged to groom the nails after a working day, which usually is done under conditions away from a dressing table upon which a bottle of nail polish and other implements may be properly supported. This situation is accordingly objectionable and is in need of an improvement.

SUMMARY OF THE INVENTION

Therefore it is a principal object of the present invention to provide a readily portable nail polishing station that can be carried in a lady's handbag or purse and which serves to safely support an opened nail polish bottle from spilling and which allows the bottle to be located very close to the nail being polished, thus preventing any polish from being dripped on other objects.

Another object is to provide a Polish Fast device which is ideal for use also at home by allowing the lady to make up her nails while seated either in bed or on a chair away from a dressing table.

Other objects are to provide a Polish Fast device which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
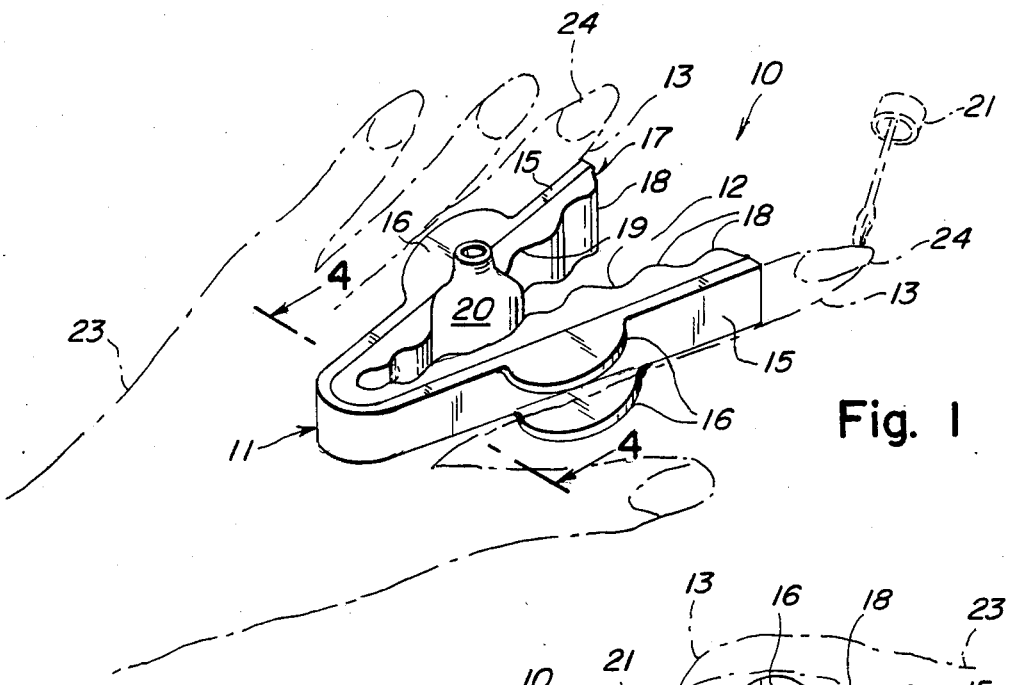
FIG. 1 is a perspective view of the invention being used to assist in a nail polishing procedure.
Figure 2:
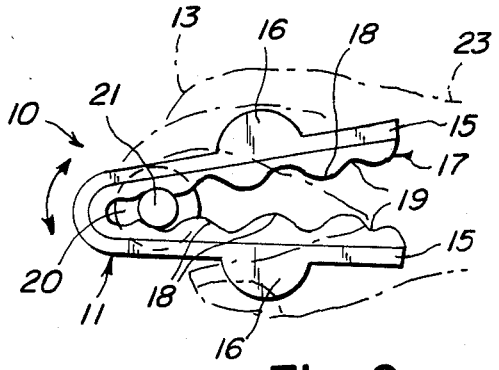
FIG. 2 is a plan view illustrating how the same device can assist in removing a tight bottle cap.

Referring now to FIGS. 1 and 2 the drawing in greater detail, the reference numeral 10 represents a Polish Fast device according to the present invention, wherein there is a V-shaped main body frame 11 is made of resilient rubber or plastic material so as to be comfortably flexible when supported in a crotch 12 formed between fingers 13 of a lady's hand 23. Each leg 15 of the frame 11 includes a sidewardly extending tab 16 along an upper and lower edge thereof for insertion of each finger 13 therebetween so as to prevent the device 10 from accidently falling off the hand 23.

A V-shaped pad 17, is adhered to an inner side of the frame 11. The inward side of each leg of the pad 17 is scallop shaped with a row of teeth 18 so as to form mating notches 19 between which a nail polish bottle 20 may be firmly gripped.

In operative use, as shown in FIG. 1, the device 10 is comfortably located near the nails 24 for working on them. The device 10 may be supported between any of the fingers 13, as wished.

As shown in FIG. 2, the device 10 can also serve as a wrench to loosen the nail bottle cap 21 from the bottle 20 if stuck hard thereto. A clip not shown may be provided on the device 10 for holding a nail file or other implements.

Figure 3:
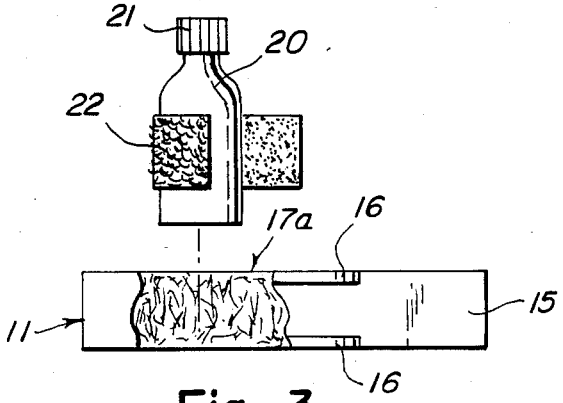
FIG. 3 is an exploded side view with parts broken away of a first modification.

FIG. 3 shows a first modification wherein the V-shaped pad **17*a* is made of loop pile fastener, known as VELCRO®. The bottle 20 has a mating loop pile fastener pad 22 adhered around its side for connecting with the pad 17*a***.

Figure 4:
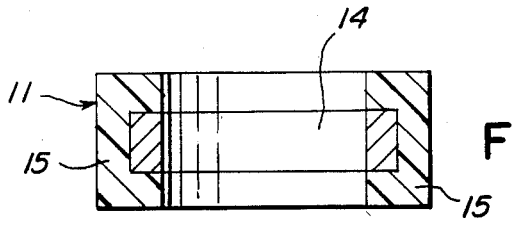
FIG. 4 is an enlarged cross sectional view taken along line 4–4 in FIG. 1 of a second modification.

FIG. 4 shows a second modification wherein a metal leaf spring 14 is embedded into the frame 11 to urge the legs 15 of the frame 11 to spread apart.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fingernail polishing device, comprising in combination, a V-shaped, flexible frame for installation between fingers of a person's hand, a toothed pad on an inner side of said frame for clamping around a nail polish bottle and a leaf spring for urging said frame in a normally spread open position.

2. The combination as set forth in claim 1, wherein sideward tabs on said frame support said device on said fingers.

3. The combination as set forth in claim 2, wherein said pad is made of VELCRO® loop pile fastener material, and a mating pad of VELCRO® loop pile fastener material is adhered around a body of said bottle.

* * * * *